US007007313B1

(12) United States Patent
Johnson

(10) Patent No.: US 7,007,313 B1
(45) Date of Patent: Mar. 7, 2006

(54) TOILET PROTECTOR

(76) Inventor: Phillip Johnson, 2912 Rolling Meadows La., New Haven, IN (US) 46774

( * ) Notice: Subject to any disclaimer, the term of this patent is extended or adjusted under 35 U.S.C. 154(b) by 0 days.

(21) Appl. No.: 11/139,226

(22) Filed: May 26, 2005

Related U.S. Application Data

(60) Provisional application No. 60/611,096, filed on Sep. 16, 2004.

(51) Int. Cl.
*A47K 10/18* (2006.01)

(52) U.S. Cl. ..... 4/300.3; 4/DIG. 5

(58) Field of Classification Search ..... 4/300.3, 4/DIG. 5
See application file for complete search history.

(56) References Cited

U.S. PATENT DOCUMENTS

| | | | | |
|---|---|---|---|---|
| 1,857,328 | A * | 5/1932 | Piper | 4/144.1 |
| 4,198,716 | A * | 4/1980 | Hollyday, III | 4/254 |
| 4,910,815 | A | 3/1990 | Kelley | |
| D405,168 | S | 2/1999 | Henry | |
| 6,289,527 | B1 | 9/2001 | Truettner | |
| 6,408,447 | B1 * | 6/2002 | Burbank et al. | 4/300.3 |
| 6,708,350 | B1 * | 3/2004 | Devereux | 4/300.3 |

* cited by examiner

*Primary Examiner*—David J. Walczak
*Assistant Examiner*—Huyen Le

(57) ABSTRACT

A health apparatus to be used in conjunction with toilets. The apparatus works to prevent contact from men's or women's genitals with either the toilet bowl itself or the water within the toilet bowl.

2 Claims, 3 Drawing Sheets

TOILET PROTECTOR

I. CROSS-REFERENCE TO RELATED APPLICATIONS

This application claims the benefit of U.S. Provisional Application No. 60/611,096 filed Sep. 16, 2004.

II. BACKGROUND OF THE INVENTION

The present invention concerns that of a new and improved health apparatus to be used in conjunction with toilets.

III. DESCRIPTION OF THE PRIOR ART

U.S. Pat. No. 4,910,815, issued to Kelley, discloses a sanitary toilet seat device comprised of a concave member for attachment to a seat to prevent the user from contacting the inner surface of the commode.

U.S. Pat. No. 5,289,537, issued to Granger, discloses a sanitary toilet device comprised of an accurate piece extending downward from the seat to prevent urine from squirting out of the gap between the seat and the bowl.

U.S. Pat. No. D45,168, issued to Henry, discloses an ornamental design for a urine deflector device.

IV. SUMMARY OF THE INVENTION

The present invention concerns that of a new and improved health apparatus to be used in conjunction with toilets. The apparatus works to prevent contact from men's or women's genitals with either the toilet bowl itself or the water within the toilet bowl.

There has thus been outlined, rather broadly, the more important features of a health apparatus used in conjunction with toilets that the detailed description thereof that follows may be better understood and in order that the present contribution to the art may be better appreciated. There are, of course, additional features of the health apparatus used in conjunction with toilets that will be described hereinafter and which will form the subject matter of the claims appended hereto.

In this respect, before explaining at least one embodiment of the health apparatus used in conjunction with toilets in detail, it is to be understood that the health apparatus used in conjunction with toilets is not limited in its application to the details of construction and to the arrangements of the components set forth in the following description or illustrated in the drawings. The health apparatus used in conjunction with toilets is capable of other embodiments and being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present health apparatus used in conjunction with toilets. It is important, therefore, that the claims be regarded as including such equivalent constructions insofar as they do not depart from the spirit and scope of the present invention.

It is therefore an object of the present invention to provide a health apparatus used in conjunction with toilets which has all of the advantages of the prior art and none of the disadvantages.

It is another object of the present invention to provide a health apparatus used in conjunction with toilets which may be easily and efficiently manufactured and marketed.

It is another object of the present invention to provide a health apparatus used in conjunction with toilets which is of durable and reliable construction.

It is yet another object of the present invention to provide a health apparatus used in conjunction with toilets which is economically affordable and available for relevant market segment of the purchasing public.

Other objects, features and advantages of the present invention will become more readily apparent from the following detailed description of the preferred embodiment when considered with the attached drawings and appended claims.

V. BRIEF DESCRIPTION OF THE DRAWINGS

VI. DESCRIPTION OF THE PREFERRED EMBODIMENT

Figure 1:
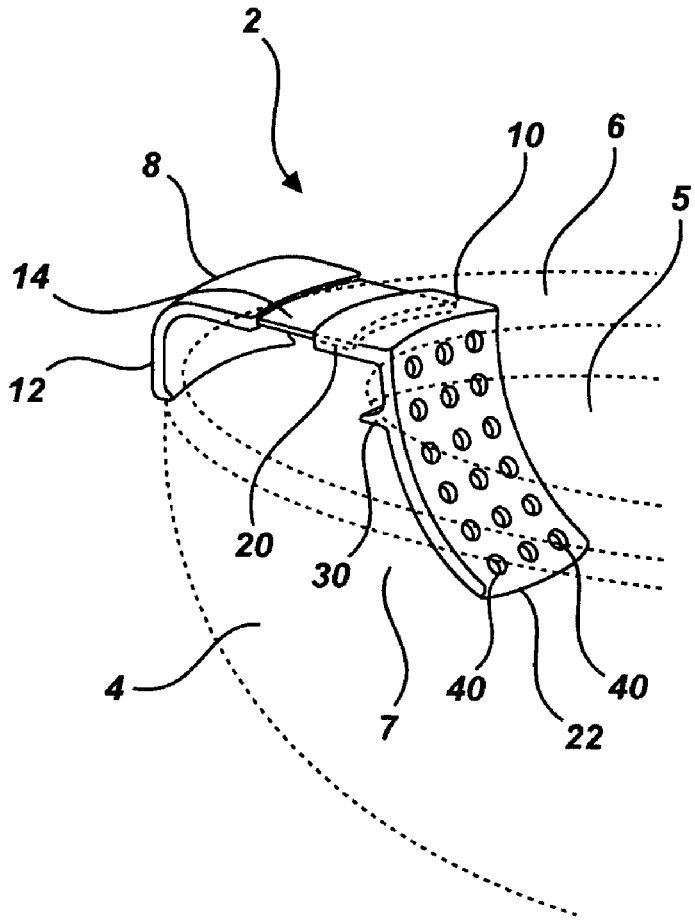
FIG. 1 shows a perspective view of the preferred embodiment of the health apparatus.

FIG. 1 shows a perspective view of the preferred embodiment of the health apparatus 2. Health apparatus 2 is designed to be in conjunction with a toilet bowl 4 of a toilet and is designed to stop the embarrassment of splashing urine and also cut down on yeast infection.

Toilet bowl 4, as seen in FIG. 1, has a continuous rim 6 and has two surfaces, an inner surface 5 and an outer surface 7. Health apparatus 2 itself comprises two portions, an outer portion 8 and an inner portion 10. Outer portion 8 itself comprises an outer elbow 12 and a connector piece 14.

Outer elbow 12 has two ends, a first end and a second end. The first end of the outer elbow 12 is designed to secure around the outer surface 7 of the rim 6 of the toilet bowl 4. Outer elbow 12 curves around and over the rim 6 of the toilet bowl 4, with outer elbow 12 having a ninety-degree curve. The second end of the outer elbow 12 rests over the toilet bowl 4 itself.

Connector piece 14 has two ends, a first end and a second end. The first end of the connector piece 14 is fixedly attached to the second end of the outer elbow 12.

The inner portion 10 itself comprises two portions which are a receiver portion 20 and a splash guard 22. Receiver portion has two ends, a first end and a second end, with the first end of the receiver portion 20 designed to receive the second end of the connector piece 14 of the outer portion 8.

Splash guard 22 has two ends, an upper end and a lower end, and has a concave shape. The upper end of splash guard 22 is attached to the second end of the receiver portion 20 at a ninety degree angle. Splash guard 22 also has two surfaces, an inner surface and an outer surface, with a back lip 30 attached to the inner surface of the splash guard 22. The back lip 30 is designed to be pressed against the inner surface 5 of the toilet bowl 4 when the health apparatus is in use.

Splash guard 22 also has a plurality of holes 40 in it, which are designed to allow any captured urine or toilet bowl water to easily fall through the splash guard 22 back into the confines of the toilet bowl 4.

Figure 2:
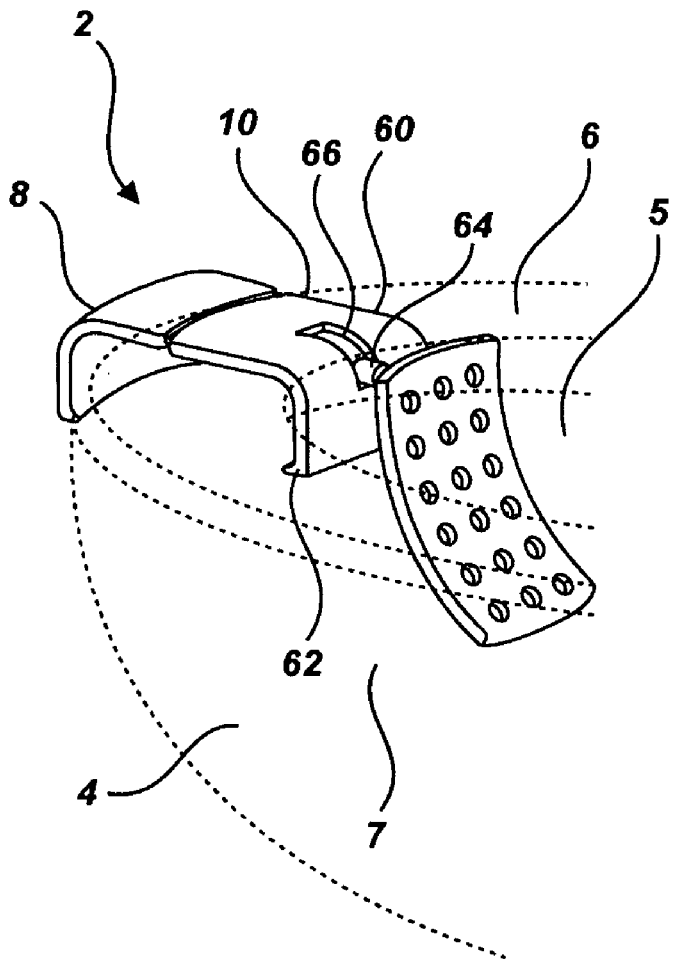
FIG. 2 shows a perspective view of an alternative embodiment of the health apparatus.
Figure 3:
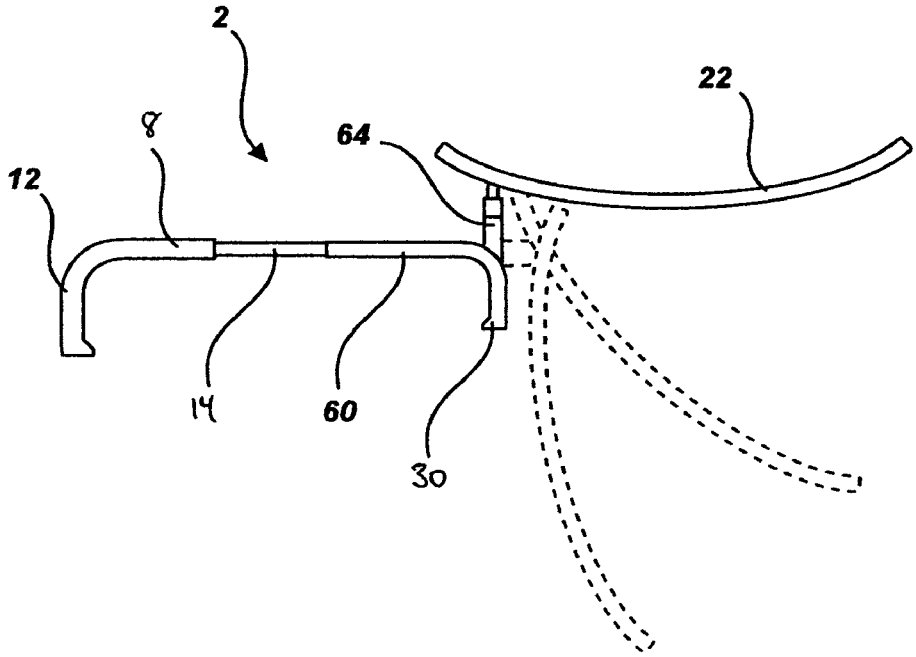
FIG. 3 shows a side view of an alternative embodiment of the health apparatus.

FIG. 2 shows a perspective view of an alternative embodiment of the health apparatus 2, while FIG. 3 shows a side view of an alternative embodiment of the health apparatus 2. In this embodiment, splash guard 22 does not have a back lip attached to it. Furthermore, connector piece 14 of outer portion 8 is replaced by inner attachment piece 60, which curves around the rim 6 of the toilet bowl 4 and has a back lip 62. Inner attachment piece 60 still has the adjustability characteristics of the connector piece 14 shown in the preferred embodiment.

In the alternative embodiment, splash guard 22 is attached to the inner attachment piece 60 via a connector piece 64, which can be adjusted within a hole 66 located on the inner attachment piece 60. Splash guard 22 can essentially be adjusted to any position in between essentially a vertical position to essentially a horizontal position.

Normally, FIG. 1 is the preferred embodiment for men, while FIG. 2 is the preferred embodiment for women. The health apparatus would be used by men to prevent their genitals from touching the inside of a toilet bowl, which typically harbors lots of bacteria and germs. Furthermore, the health apparatus can be used by women to prevent them from splashing toilet water within the bowl up on their genitals.

What I claim as my invention is:

1. A health apparatus in combination with a toilet bowl, the toilet bowl including a continuous rim, the toilet bowl also including two surfaces comprising an inner surface and an outer surface, the health apparatus comprising:

(a) an outer portion, the outer portion comprising an outer elbow and a connector piece, the outer elbow having two ends, a first end and a second end, the first end of the outer elbow being designed to secure around the outer surface of the continuous rim of the toilet bowl, the outer elbow having a ninety-degree curve, the second end of the outer elbow resting over the toilet bowl itself, the connector piece having two ends, a first end and a second end, the first end of the connector piece being fixedly attached to the second end of the outer elbow, (b) an inner portion, the inner portion comprising a receiver portion and a splash guard, the receiver portion having two ends, a first end and a second end, the first end of the receiver portion designed to receive the second end of the connector piece of the outer portion, the splash guard having two ends, an upper end and a lower end, the splash guard having a concave shape, the upper end of the splash guard being attached to the second end of the receiver portion at a ninety degree angle, the splash guard having two surfaces, an inner surface and an outer surface, (c) a back lip attached to the inner surface of the splash guard, the back lip designed to be pressed against the inner surface of the toilet bowl when the health apparatus is in use, and (d) a plurality of holes located in the splash guard, wherein the holes allow any urine or toilet bowl water to easily fall through the splash guard back into the confines of the toilet bowl.

2. A health apparatus in combination with a toilet bowl, the toilet bowl including a continuous rim, the toilet bowl also including two surfaces comprising an inner surface and an outer surface, the health apparatus comprising:

(a) an outer portion, the outer portion comprising an outer elbow and an inner attachment piece, the outer elbow having two ends, a first end and a second end, the first end of the outer elbow being designed to secure around the outer surface of the continuous rim of the toilet bowl, the outer elbow having a ninety-degree curve, the second end of the outer elbow resting over the toilet bowl itself, the inner attachment piece curving around the rim of the toilet bowl, the inner attachment piece having a back lip, (b) an inner portion, the inner portion comprising a receiver portion and a splash guard, the receiver portion having two ends, a first end and a second end, the first end of the receiver portion designed to receive the second end of the connector piece of the outer portion, the splash guard having two ends, an upper end and a lower end, the splash guard having a concave shape, the splash guard being attached to the inner attachment piece via a connector piece, the splash guard having two surfaces, an inner surface and an outer surface, (c) a plurality of holes located in the splash guard, wherein the holes allow any urine or toilet bowl water to easily fall through the splash guard back into the confines of the toilet bowl, (d) wherein the splash guard can be adjusted to any position in between an essentially vertical position and an essentially horizontal position.

* * * * *